US008623151B2

(12) United States Patent
Olson et al.

(10) Patent No.: US 8,623,151 B2
(45) **Date of Patent: *Jan. 7, 2014**

(54) TERPOLYMER CONTAINING MALEIC ACID, VINYL ACETATE, AND ALKYL ACRYLATE MONOMERS FOR ALUMINUM PROTECTION

(75) Inventors: Erik C. Olson, Eagan, MN (US); Carter Silvernail, Burnsville, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/428,622

(22) Filed: Mar. 23, 2012

(65) Prior Publication Data

US 2013/0252872 A1 Sep. 26, 2013

(51) Int. Cl.
*B08B 3/04* (2006.01)
*C11D 3/08* (2006.01)

(52) U.S. Cl.
USPC ..... 134/25.2; 134/25.3; 134/39; 134/42; 510/223; 510/229; 510/230; 510/232; 510/233; 510/252; 510/421; 510/434; 510/445; 510/466; 510/475; 510/476; 510/477; 510/478; 510/488; 510/509

(58) Field of Classification Search
USPC ..... 510/223, 229, 230, 232, 233, 252, 421, 510/434, 445, 466, 475, 476, 477, 478, 488, 510/509; 134/25.2, 25.3, 39, 42
See application file for complete search history.

(56) References Cited

U.S. PATENT DOCUMENTS

| | | | |
|---|---|---|---|
| 3,048,548 | A | 8/1962 | Martin et al. |
| 3,321,408 | A | 5/1967 | Briggs |
| 3,334,147 | A | 8/1967 | Brunelle et al. |
| 3,422,021 | A | 1/1969 | Roy |
| 4,618,914 | A | 10/1986 | Sato et al. |
| 4,782,901 | A | 11/1988 | Phelps et al. |
| 4,830,773 | A | 5/1989 | Olson |
| 4,834,955 | A | 5/1989 | Mouche et al. |
| 5,191,048 | A | 3/1993 | Swift et al. |
| 5,290,468 | A | 3/1994 | Turcotte et al. |
| 5,346,974 | A | 9/1994 | Iovine et al. |
| 5,574,113 | A | 11/1996 | Kroner et al. |
| 5,574,120 | A | 11/1996 | Heidel et al. |
| 5,576,407 | A | 11/1996 | Kroner et al. |
| 5,876,514 | A | 3/1999 | Rolando et al. |
| 5,900,229 | A | 5/1999 | Dupuis |
| 5,929,014 | A | 7/1999 | Beaujean et al. |
| 6,200,498 | B1 | 3/2001 | Artiga Gonzalez et al. |
| 6,340,664 | B1 | 1/2002 | Gassenmeier et al. |
| 6,383,993 | B1 | 5/2002 | Maurin et al. |
| 6,383,994 | B1 | 5/2002 | Maurin et al. |
| 6,383,995 | B1 | 5/2002 | Beauquey et al. |
| 6,383,996 | B1 | 5/2002 | Maurin et al. |
| 6,387,864 | B1 | 5/2002 | Bartelme |
| 6,403,524 | B2 | 6/2002 | Scott et al. |
| 6,432,894 | B1 | 8/2002 | Maurin et al. |
| 6,534,455 | B1 | 3/2003 | Maurin et al. |
| 6,562,772 | B1 | 5/2003 | Maurin et al. |
| 6,812,194 | B2 | 11/2004 | Ruhr et al. |
| 6,820,626 | B1 | 11/2004 | Jonke et al. |
| 7,375,070 | B2 | 5/2008 | Pegelow et al. |
| 7,524,803 | B2 | 4/2009 | Lentsch et al. |
| 7,638,473 | B2 | 12/2009 | Smith et al. |
| 2003/0056301 | A1 | 3/2003 | Dekker et al. |
| 2003/0158078 | A1 | 8/2003 | Chang |
| 2004/0053808 | A1 | 3/2004 | Raehse et al. |
| 2004/0106534 | A1 | 6/2004 | Nitsch et al. |
| 2004/0152616 | A1 | 8/2004 | Murphy et al. |
| 2005/0205574 | A1 | 9/2005 | Lambotte et al. |
| 2005/0225003 | A1 | 10/2005 | Holderbaum et al. |
| 2006/0035804 | A1 | 2/2006 | Penninger et al. |
| 2009/0010855 | A1 | 1/2009 | Lepilleur et al. |
| 2009/0069202 | A1 | 3/2009 | Strapp et al. |
| 2009/0105114 | A1 | 4/2009 | Stolte et al. |
| 2009/0305934 | A1 | 12/2009 | Creamer et al. |
| 2010/0189664 | A1 | 7/2010 | Castro et al. |
| 2013/0005639 | A1* | 1/2013 | Miralles et al. ..... 510/471 |

FOREIGN PATENT DOCUMENTS

| | | | |
|---|---|---|---|
| EP | 0451434 | B1 | 10/1991 |
| EP | 0510944 | B1 | 10/1992 |
| EP | 0524546 | A2 | 1/1993 |
| EP | 0760846 | B1 | 3/1997 |
| EP | 0798320 | A2 | 10/1997 |
| EP | 0835925 | A2 | 4/1998 |
| EP | 0881281 | A2 | 12/1998 |
| EP | 0884298 | A2 | 12/1998 |
| EP | 1093787 | B1 | 4/2001 |

(Continued)

OTHER PUBLICATIONS

Florjanczyk, Zbigniew et al., "Terpolymerization of maleic anhydride with vinyl monomers", Journal of Polymer Science, part A: Polymer Chemistry, Nov. 1989, vol. 27, No. 12, pp. 4099-4108.

Hiraguri, Yoichi et al., "Syntheses of biodegradable functional polymers by radical ring-opening polymerization of 2-methylene-1,3,6-trioxocane", Journal of Polymers and the Environment, 2010, v. 18, No. 2, pp. 116-121.

Li, Xiaofang et al., "Photocopolymerization of maleic anhydride and vinyl acetate", Chinese Journal of Polymer Science (English Edition), 1990, vol. 8, No. 3, pp. 261-268.

*Primary Examiner* — Brian P Mruk
(74) *Attorney, Agent, or Firm* — Andrew D. Sorensen; Shaoni L. Mitchell

(57) ABSTRACT

A cleaning composition includes an alkali metal silicate, a polymer including maleic acid, vinyl acetate and alkyl acrylate monomers, and optionally water. The cleaning composition can include approximately 10% and approximately 90% by weight of at least one alkali metal silicate, greater than or equal to approximately 0.1% by weight of the polymer containing maleic acid, vinyl acetate and alkyl acrylate monomers, and approximately 0% to approximately 80% by weight water.

7 Claims, No Drawings

(56) References Cited

FOREIGN PATENT DOCUMENTS

| | | | |
|---|---|---|---|
| EP | 1735418 | B1 | 12/2006 |
| WO | WO9530732 | A1 | 11/1995 |
| WO | WO9811187 | A1 | 3/1998 |
| WO | WO0070006 | A1 | 11/2000 |
| WO | WO2008079855 | A2 | 7/2008 |

* cited by examiner

TERPOLYMER CONTAINING MALEIC ACID, VINYL ACETATE, AND ALKYL ACRYLATE MONOMERS FOR ALUMINUM PROTECTION

CROSS REFERENCE TO RELATED APPLICATIONS

This application is related to U.S. application Ser. No. 13/428,632, filed Mar. 23, 2012, entitled "A METHOD FOR REDUCED ENCRUSTATION OF TEXTILES USING A POLYMER COMPRISING MALEIC ACID, VINYL ACETATE, AND ALKYL ACRYLATE," U.S. application Ser. No. 13/428,643, filed Mar. 23, 2012, entitled "A CLEANING COMPOSITION INCLUDING A TERPOLYMER CONTAINING MALEIC ACID, VINYL ACETATE, AND ALKYL ACRYLATE MONOMERS FOR ENHANCED SCALE CONTROL," and to U.S. application Ser. No. 13/428,637, filed Mar. 23, 2012, entitled "A CLEANING COMPOSITION INCLUDING A TERPOLYMER CONTAINING MALEIC ACID, VINYL ACETATE, AND ALKYL ACRYLATE MONOMERS FOR ENHANCED SCALE CONTROL," which were filed concurrently herewith. The entire contents of these patent applications are hereby expressly incorporated herein by reference including without limitation, the specification, claims, and abstract, as well as any figures, tables or drawings thereof.

TECHNICAL FIELD

The present invention is related to the field of high alkaline detergents. In particular, the present invention is related to a detergent composition including at least one alkali metal silicate, a polymer including maleic acid, vinyl acetate and alkyl acrylate segments or monomers, and optionally water for controlling corrosion.

BACKGROUND

Conventional detergents used in warewashing include alkaline detergents. Alkaline detergents, particularly those intended for institutional use, can affect the appearance of metals, particularly soft metals such as aluminum. For example, alkaline detergents can create blackening or corrosion on aluminum pans. Conventionally, alkaline detergents have contained phosphorous to reduce corrosion. However, increased regulation of the use of phosphorous in detergents has created a need to identify alternative anti-corrosion compositions.

SUMMARY

The present invention includes a cleaning composition for removing soils. The cleaning composition includes at least one alkali metal silicate, a polymer comprising maleic acid, vinyl acetate and alkyl acrylate monomers, and optionally water.

In one embodiment, the present invention is a cleaning composition including at least one alkali metal silicate in an amount between approximately 10% and approximately 90% of by weight, a polymer containing maleic acid, vinyl acetate and alkyl acrylate monomers in an amount greater than or equal to approximately 0.1% by weight, and optionally water.

In yet another embodiment, the detergent is used in a method of removing soils. A detergent is mixed with water to form a use composition. The detergent comprises an alkali metal silicate and a polymer composed of maleic acid, vinyl acetate and alkyl acrylate monomers. The use composition has a polymer concentration of approximately 20 to approximately 1,000 parts per million. In a still further embodiment, the detergent is used in a method of cleaning aluminum articles.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The present detergent compositions provide a high alkalinity detergent including at least one alkali metal silicate, a polymer including maleic acid, vinyl acetate and alkyl acrylate monomers and optionally water. Such compositions may be particularly useful in inhibiting aluminum corrosion. The term aluminum corrosion refers to aluminum discoloration, weight loss and/or solublization of an aluminum surface. Further, such compositions can be biodegradable and substantially free of phosphorous containing components to comply with various regulatory requirements.

The present detergent composition can be used in any environment in which it is desirable to provide metal protection and corrosion prevention, and more particularly, aluminum metal protection and corrosion prevention. Example applications include vehicle care applications, warewashing applications, laundering applications, and food and beverage applications. More particularly, example applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners. Methods of using the detergent composition are also provided.

The detergent composition generally includes at least one alkali metal silicate, a polymer including maleic acid, vinyl acetate and alkyl acrylate monomers or segments and optionally water. The detergent composition can include an effective amount of alkali metal silicate to enhance cleaning of the desired substrate and improve soil removal performance of the composition. An effective amount of the alkali metal silicate source may provide a use composition (i.e., an aqueous solution containing the composition) having a pH of at least about 10.

A suitable concentration range of the components in the detergent composition include between approximately 10% and approximately 90% by weight of the alkali metal silicate, and greater than or equal to approximately 0.1% by weight of the polymer containing maleic acid, vinyl acetate and alkyl acrylate monomers. The composition may optionally include water in the range of 0% to approximately 80%. A particularly suitable concentration range of the components in the detergent composition include between approximately 10% and approximately 90% by weight of the alkali metal silicate, between approximately 0.1% and approximately 20% by weight of the polymer containing maleic acid, vinyl acetate and alkyl acrylate monomers and optionally water in the amount of 0% to approximately 70%. A more particularly suitable concentration range of the components in the detergent composition include between approximately 30% and approximately 70% by weight of the alkali metal silicate, between approximately 1% and 15% by weight of the polymer containing maleic acid, vinyl acetate and alkyl acrylate monomers and optionally water in the amount of 0% to approximately 60%. In one particular example, the detergent composition includes between approximately 10% and approximately 90% by weight of the alkali metal silicate, between approximately 0.1% and 20% by weight of the polymer containing maleic acid, vinyl acetate and ethyl acrylate monomers and optionally water in the amount of 0% to approximately 70%. In another example, the detergent composition includes between approximately 30% and approximately 70% by weight of the alkali metal silicate, between approximately 1% and 15% by weight of the polymer containing maleic acid, vinyl acetate and ethyl acrylate monomers and optionally water in the amount of 0% to approximately 60%.

Examples of suitable alkali metal silicates include lithium, sodium and potassium silicate or metasilicate, as well as combinations of the foregoing materials. The alkali metal silicate may be used to form the composition without modification or may be combined with other raw materials such as alkali metal hydroxide to form alkali metal metasilicate prior to or in the process of making the solid composition. Commercial sodium silicates are available in both powdered and liquid forms. The powdered forms include both amorphous and crystalline powders in either hydrated or anhydrous form. The aqueous liquids are available with viscosities ranging from 0.5 to 600,000 centipoise at 20° C. Potassium silicates are sold either as a glass or an aqueous liquid. The synthetic lithium silicates typically are generally sold only as liquids. The more common commercially available sodium silicates vary in $Na_2O/SiO_2$ ratio from about 2:1 to about 1:4.

The solid forms of alkali metal silicates are generally classified by particle-size range and $Na_2O/SiO_2$ ratio. The aqueous solutions are identified by any combination of density/specific gravity, alkali:silica ratio, and viscosity. Typically, the aqueous solutions are differentiated on the basis of specific gravity and $Na_2O/SiO_2$ ratio. Concentrated solutions of highly alkali sodium silicates are quite sticky or tacky. Conversely, concentrated solutions of highly siliceous sodium silicate show little tack but are plastic enough to form into balls which show a surprising elasticity.

The crystalline products which are readily available on a commercial scale are the anhydrous and hydrated sodium metasilicates ($Na_2SiO_3$, $Na_2SiO_35H_2O$ and $SiO_39H_2O$) and the hydrated sodium sesquisilicates ($Na_2HSiO_45H_2O$ and $3Na_2O_2.SiO_211H_2O$). The anhydrous sodium sesquisilicate and the technically anhydrous orthosilicates are also available but generally mixtures of caustic soda and sodium metasilicate.

The liquid products which are readily available on a commercial scale include $M_2O:SiO_2$ ratios from about 1:1.5 to 1:3.8 for sodium silicate and about 1:1.5 to about 1:2.5 for potassium silicate with a water content from about 45 to about 75 wt % based upon the weight of the silicate and the water.

A listing of commercially available alkali metal silicates are provided in Tables 1 and 2 below. The physical properties of various crystalline alkali silicates are provided in Table 3 below.

TABLE 1

Commercial Solid Silicates

| Name | $M_2O:SiO_2$ (wt) | % $M_2O$ | % $SiO_2$ | % $H_2O$ | Softening Pt (° C.) | Flow Pt (° C.) |
|---|---|---|---|---|---|---|
| Sodium | 1:3.22 | 23.5 | 75.7 | — | 655 | 840 |
| Silicate | 1:2.00 | 33.0 | 66.0 | — | 590 | 760 |
| (anhydrous glasses) | | | | | | |
| Potassium Silicate (anhydrous glasses) | 1:2.50 | 28.3 | 70.7 | — | 700 | 905 |
| Sodium | 1:3.22 | 19.2 | 61.8 | 18.5 | — | — |
| Silicates | 1:2.00 | 27.0 | 54.0 | 18.5 | — | — |
| (hydrated amphorous powders) | | | | | | |

TABLE 2

| Name | ($M_2O:SiO_2$) (wt) | % $M_2O$ | % $SiO_2$ | Baume at 20° C. | Specific Gravity | Viscosity (Poise/ 20° C.) |
|---|---|---|---|---|---|---|
| Sodium | 1:160 | 19.70 | 31.5 | 58.3 | 1.68 | 70.00 |
| Silicate | 1:2.00 | 18.00 | 36.0 | 59.3 | 1.69 | 700.00 |
| (solutions) | 1:2.50 | 10.60 | 26.5 | 42.0 | 1.41 | 0.60 |
| | 1:2.88 | 11.00 | 31.7 | 47.0 | 1.49 | 9.60 |
| | 1:3.22 | 8.90 | 28.7 | 41.0 | 1.39 | 1.80 |
| | 1:3.75 | 6.80 | 25.3 | 35.0 | 1.32 | 2.20 |
| Potassium | 1:2.50 | 8.30 | 20.8 | 29.8 | 1.26 | 0.40 |
| Silicate | 1:2.20 | 9.05 | 19.9 | 30.0 | 1.26 | 0.07 |
| (solutions) | 1:2.10 | 12.50 | 26.3 | 40.0 | 1.38 | 10.50 |
| | 1:1.80 | 10.40 | 29.5 | 47.7 | 1.49 | 13.00 |
| Lithium | 1:9.4 | 2.20 | 20.7 | — | — | — |
| Silicate | 1:9.6 | 2.10 | 20.0 | — | — | 4.00 |
| (solutions) | 1:11.8 | 1.60 | 18.8 | — | — | — |
| | 1:17.0 | 1.20 | 20.0 | — | — | 2.50 |

TABLE 3

| Name | Formula | Melting Point (° C.) | Density (g/ml) | ΔH cal/wt at 25° | RI alpha | RI beta | RI gamma |
|---|---|---|---|---|---|---|---|
| Sodium Orthosilicate | $Na_4SiO_4$ ($2Na_2O•SiO_2$) | 1118 | 2.50 | −497,800 | 1.524 | — | 1.537 |
| Sodium Sesquisilicate | $Na_6Si_2O_7$ ($3Na_2O•2SiO_2$) | 1122 | 2.96 | −856,300 | 1.524 | — | 1.529 |
| Sodium Sesquisilicate Pentahydrate | $Na_6Si_2O_75H_2O$ ($3Na_2O•2SiO_25H_2O$) | 88 | — | −1,648,000 | 1.502 | 1.510 | 1.524 |
| Sodium Metasilicate | $Na_2SiO_3$ ($Na_2O•SiO2$) | 1089 | 2,614 | −364,700 | 1,490 | 1.500 | 1.510 |

TABLE 3-continued

| Name | Formula | Melting Point (° C.) | Density (g/ml) | ΔH cal/wt at 25° | RI alpha | RI beta | RI gamma |
|---|---|---|---|---|---|---|---|
| Sodium Metasilicate Pentahydrate | $Na_2SiO_35H_2O$ ($Na_2O•Si_2O_25H_2O$) | 72.2 | 1.749 | −722,100 | 1.447 | 1.454 | 1.467 |
| Sodium Metasilicate hexahydrate | $Na_2SiO_36H_2O$ ($Na_2O•SiO_36H_2O$) | 70 62.9 | 1.807 | −792,600 | 1488 1.465 | — 1.475 | 1.495 1.465 |
| Sodium Metasilicate Octahydrate | $Na_2SiO_38H_2O$ ($Na_2O•SiO_38H_2O$) | 48.35 | 1.672 | −934,800 | 1.475 | 1.463 | 1.465 |
| Sodium Metasilicate Nanohydrate | $Na_2SiO_39H_2O$ ($Na_2O•SiO_29H_2O$) | 47.85 | 1.646 | −1,005,100 | 1.451 | 1.456 | 1.460 |
| Sodium | $Na_2Si_2O_5$ | 874 | 2.964 | −576,100 | 1.500 | 1.510 | 1.518 |

The detergent composition further includes a polymer containing maleic acid, alkyl acrylate and vinyl acetate monomers, which may function as a metal protector or corrosion preventer in the use composition. The maleic acid, alkyl acrylate and vinyl acetate polymer may include one or more alkyl acrylate monomers. Suitable alkyl acrylate monomers include but are not limited to methyl acrylate, ethyl acrylate, propyl acrylate, butyl acrylate, isopropyl acrylate and tert-butyl acrylate.

In one example, the polymer is a terpolymer containing maleic acid, alkyl acrylate and vinyl acetate monomers. A suitable maleic acid, alkyl acrylate and vinyl acetate terpolymer has a molecular weight between about 500 g/mol and about 5,000 g/mol. A more suitable maleic acid, alkyl acrylate and vinyl acetate terpolymer has a molecular weight between about 500 g/mol and about 3,000 g/mol. The polymer may comprise between about 30% and about 99% by weight maleic acid, between about 1% and about 60% by weight vinyl acetate and between about 1% and about 60% by weight alkyl acrylate. In a specific example the terpolymer may comprise between about 40% and about 99% by weight maleic acid, between about 1% and about 50% by weight vinyl acetate and between about 1% and about 50% by weight ethyl acrylate.

The maleic acid, alkyl acrylate and vinyl acetate polymer can be biodegradable. A suitable maleic acid, alkyl acrylate and vinyl acetate terpolymer can be at least about 15% biodegradable. A particularly suitable maleic acid, alkyl acrylate and vinyl acetate terpolymer can be between about 15% and 60% biodegradable after 35 days using the test protocol of OECD 302B. Example commercially available maleic acid, alkyl acrylate and vinyl acetate terpolymers include Belclene® 283 and Belclene® 810 both available from BWA, Tucker, Ga.

The alkyl acrylate and vinyl acetate monomers may hydrolyze in the concentrate or in the use composition. For example, at high pH the alkyl acrylate and/or vinyl acetate segments can hydrolyze to carboxylic acids. As used herein, reference to an alkyl acrylate and/or vinyl acetate monomer includes all hydrolyzed forms of such monomer. The alkyl acrylate and/or vinyl acetate segments may be partially or completely hydrolyzed in the concentrate and/or use solution. In one example the polymer may include at least one hydrolyzed vinyl acetate or alkyl acrylate monomer. Additionally, as used herein, reference to maleic acid monomers include monomers of maleic acid and salts thereof.

The detergent composition can also include water, which may be provided in the composition as a result of its presence in an aqueous material that is added to the detergent composition or may be independently added. It should be understood that the reference to water includes water of hydration and free water. The phrase "water of hydration" refers to water which is somehow attractively bound to a non-water molecule. An exemplary form of attraction includes hydrogen bonding. In addition to hydrating the alkalinity source/hydratable salt, the water of hydration also functions to increase the viscosity of the mixture during processing and cooling to prevent separation of the components. The amount of water in the detergent composition will depend on the alkalinity source/hydratable salt.

The detergent composition can be phosphorus-free and/or nitrilotriacetic acid (NTA)-free to make the detergent composition more environmentally beneficial. Phosphorus-free means a composition having less than approximately 0.5 wt %, more particularly less than approximately 0.1 wt %, and even more particularly less than approximately 0.01 wt % phosphorous based on the total weight of the composition. NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent.

Additional Functional Materials

The detergent composition can also include various additional functional components. In some embodiments, the alkali metal silicate, a surfactant, and the maleic acid, alkyl acrylate and vinyl acetate polymer make up a large amount, or even substantially all of the total weight of the detergent composition, for example, in embodiments having few or no additional functional materials disposed therein. In one specific example, the detergent composition consists essentially of a surfactant, an alkalinity source that includes an alkali metal silicate and a maleic acid, vinyl acetate and alkyl acrylate terpolymer. In another specific example, the detergent composition consists essentially of a surfactant, an alkalinity source that includes an alkali metal silicate and a maleic acid, vinyl acetate and alkyl acrylate polymer. In these embodiments, the component concentration ranges provided above for the detergent are representative of the ranges of those same components in the detergent composition.

In alternative embodiments, functional materials are added to provide desired properties and functionalities to the detergent composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multi-functional and may also provide several of the functional benefits discussed below.

Secondary Alkali Source

In one embodiment, the detergent composition includes one or more secondary alkali source(s) in addition to the alkali metal silicate. An alkalinity source, comprised of the secondary alkali source(s) and the alkali metal silicate, can be present in an effective amount to enhance cleaning of the desired substrate and can provide a use composition having a pH of at least about 10. The secondary alkali source is present is an amount less than the alkali metal silicate. A suitable concentration range for the components of this detergent composition include between approximately 30% and approximately 90% by weight of the alkalinity source, between approximately 15% and approximately 50% by weight of the secondary alkali source(s), and between approximately 0.1% and 20% by weight of the polymer containing maleic acid, vinyl acetate and alkyl acrylate monomers. A particularly suitable concentration range of the components in the detergent composition include between approximately 30% and approximately 70% by weight of the alkalinity source, between approximately 20% and approximately 40% by weight of the second alkali source, and between approximately 1% and 15% by weight of the polymer containing maleic acid, vinyl acetate and alkyl acrylate monomers.

Examples of suitable secondary alkali sources of the detergent composition include, but are not limited to alkali metal carbonates, alkali metal hydroxides and alkali metal silicates. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the composition in any form known in the art, including as solid beads, dissolved in an aqueous solution, or a combination thereof. Examples of alkali metal silicates include, but are not limited to sodium or potassium silicate or polysilicate, sodium or potassium metasilicate and hydrated sodium or potassium metasilicate or a combination thereof.

Surfactants

The detergent composition may also include a surfactant. A variety of surfactants can be used in the detergent composition, including, but not limited to: anionic, nonionic, cationic, and zwitterionic surfactants. Exemplary surfactants that can be used are commercially available from a number of sources. For a discussion of surfactants, see Kirk-Othmer, Encyclopedia of Chemical Technology, Third Edition, volume 8, pages 900-912. When the detergent composition includes a surfactant as a cleaning agent, the cleaning agent is provided in an amount effective to provide a desired level of cleaning. The detergent composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block polymers. An example of a commercially available ethylene oxide/propylene oxide block polymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va. A particularly suitable surfactant is D500, an ethylene oxide/propylene oxide polymer available from BASF Corporation, Florham Park, N.J.

Examples of cationic surfactants that can be used in the detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the detergent composition include, but are not limited to: betaines, imidazolines, and propionates.

When the detergent composition is intended to be used in an automatic dishwashing or warewashing machine, the surfactants selected, if any surfactant is used, can be those that provide an acceptable level of foaming when used inside a dishwashing or warewashing machine. Detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders or Water Conditioners

The detergent composition can include one or more building agents, also called chelating or sequestering agents (e.g., builders), including, but not limited to: condensed phosphates, alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the solid detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration.

Examples of phosphonates include, but are not limited to: 2-phosphonobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin polymer, sulfonated polymer or terpolymer, acrylic/maleic polymer, polymethacrylic acid, acrylic acid-methacrylic acid polymers, hydrolyzed polyacrylamide, hydrolyzed polymethacrylamide, hydrolyzed polyamide-methacrylamide polymers, hydrolyzed polyacrylonitrile, hydrolyzed polymethacrylonitrile, and hydrolyzed acrylonitrile-methacrylonitrile polymers. Other suitable water conditioning polymers include starch, sugar or polyols comprising carboxylic acid or ester functional groups. Exemplary carboxylic acids include but are not limited to maleic acid, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The detergent compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the detergent composition during use.

The amount of hardening agent included in the detergent composition will vary according to factors including, but not limited to: the type of detergent composition being prepared, the ingredients of the detergent composition, the intended use of the composition, the quantity of dispensing solution applied to the solid composition over time during use, the temperature of the dispensing solution, the hardness of the dispensing solution, the physical size of the detergent composition, the concentration of the other ingredients, and the concentration of the cleaning agent in the composition. It is preferred that the amount of the hardening agent included in the detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight. In one embodiment, however, the solid composition if free of sulfates and carbonates including soda ash.

Urea particles can also be employed as hardeners in the detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the detergent compositions include, but are not limited to: chlorine-containing compounds such as chlorine, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The detergent composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the detergent composition. Examples of defoaming agents include, but are not limited to: ethylene oxide/propylene block polymers such as those available under the name Pluronic® N-3 available from BASF Corporation, Florham Park, N.J.; silicone compounds such as silica dispersed in polydimethylsiloxane, polydimethylsiloxane, and functionalized polydimethylsiloxane such as those available under the name Abil® B9952 available from Goldschmidt Chemical Corporation, Hopewell, Va.; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

The detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride polymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

The detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

The solid composition may also include saccharide stabilizing agents. The solid composition may include between about 0.5% by weight and about 25% by weight saccharide, more particularly, between about 1.0% by weight and about 15% by weight saccharide, even more particularly, between about 1.0% by weight and about 10%. Suitable saccharides for use with embodiments of the present invention include monosaccharides, disaccharides and polysaccharides, and in particular mono-, di- and polysaccharides containing 3 or more saccharide units. Exemplary saccharides include, but are not limited to glucose, fructose, lactulose galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose, amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, maltodextrin, cyclodextrin, glycogen and oligiofructose, sodium carboxymethylcellulose, linear sulfonated $\alpha$-(1,4)-linked D-glucose polymers, $\gamma$-cyclodextrin and the like. Examples of particularly suitable saccharide based sugars include, but are not limited to sucrose, fructose, inulin, lactulose, maltose and combinations thereof.

Dispersants

The detergent composition may also include dispersants. Examples of suitable dispersants that can be used in the detergent composition include, but are not limited to: maleic acid/olefin polymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 15% by weight, between approximately 0.5% to approximately 10% by weight, and between approximately 1% to approximately 5% by weight.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

Thickeners

The detergent compositions can include a rheology modifier or a thickener. The rheology modifier may provide the following functions: increasing the viscosity of the compositions; increasing the particle size of liquid use compositions when dispensed through a spray nozzle; providing the use compositions with vertical cling to surfaces; providing particle suspension within the use compositions; or reducing the evaporation rate of the use compositions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas campestras*. Xanthan may be made by fermentation based on corn sugar or other corn sweetener byproducts. Xanthan comprises a poly beta-(1-4) -D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use composition that can produce large particle size mist or aerosol when sprayed.

Methods of Manufacture

In general, the detergent composition of the present invention can be created by combining the alkali metal silicate source, the surfactant, the polymer including maleic acid, vinyl acetate and alkyl acrylate monomers, any secondary alkalinity sources, any additional functional components and any water and allowing the components to interact.

In one embodiment, the detergent compositions forms a hydrate solid detergent, and the alkali metal silicate source, the surfactant, the polymer including maleic acid, vinyl acetate and alkyl acrylate monomers, any secondary alkalinity sources, any additional functional components and water are mixed and harden into solid form. The solidification process may last from a few minutes to about six hours, depending on factors including, but not limited to: the size of the formed or cast composition, the ingredients of the composition, and the temperature of the composition. The hydrate solid detergent has a substantially homogenous composition. A hydrate solid detergent can be formed by casting, forming and extruding. Powders and tablets formed by compacting powder or granulated material are no defined as hydrate solids for the purposes of this patent application.

The solid detergent compositions may be formed using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the composition have a weight of approximately 100 grams or greater, and solid block detergents formed by the composition have a mass of between approximately 1 and approximately 10 kilograms. The solid compositions provide for a stabilized source of functional materials. In some embodiments, the solid composition may be dissolved, for example, in an aqueous or other medium, to create a concentrated and/or use composition. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the cleaning composition is discussed as being formed into a solid product, the cleaning composition may also be provided in the form of a paste, liquid or gel. When the concentrate is provided in the form of a paste, liquid or gel, enough water is added to the cleaning composition such that complete solidification of the cleaning composition is precluded. The paste, liquid or gel may be provided in the form of a unit dose or multiple use composition. In addition, dispersants and other components may be incorporated into the cleaning composition in order to maintain a desired distribution of components.

In another embodiment, the cleaning composition may take the form of a powder or granulate. The powder or granulate may be formed by grinding or formed from a solid block, capsule or tablet formed by the methods described above. Alternatively, a powder or granulated detergent may be formed by combining liquid and solid ingredients and mixing to form a flowable powder. The liquid ingredients are preferably added to the solid components prior to and/or during mixing. The liquid components may be combined prior to adding the solid components or may be added individually to the solid components. Alternatively, the liquid component(s) may be added to individual solid components or combinations of the solid components to form a flowable powder composition. The powder or granulate may be pressed to form tablets as is known in the art.

Example suitable compositions for hydrate solids, gels and pastes and liquid detergent compositions of the present invention are provided in the tables below.

Example Hydrate Solid Detergent Compositions

| | Ex. Range 1 | Ex. Range 2 | Ex. Range 3 | Ex. Range 4 |
|---|---|---|---|---|
| alkali metal silicate | 20-85 | 20-85 | 30-70 | 30-70 |
| Alkali metal carbonate | 0-60 | 0-45 | 0-35 | 0-25 |
| polymer comprising maleic acid, vinyl acetate and alkyl acrylate monomers | 1-20 | 1-15 | 1-10 | 1-10 |
| surfactant | 0-15 | 0-10 | 0-5 | 0-5 |
| Water | 0-60 | 0-50 | 0-40 | 0-25 |
| Stability enhancer | 0-20 | 0-15 | 0-10 | 0-6 |

Example Gel or Liquid Detergent Compositions

| | Ex. Range 1 | Ex. Range 2 | Ex. Range 3 | Ex. Range 4 |
|---|---|---|---|---|
| alkali metal silicate | 10-60 | 10-40 | 10-40 | 10-30 |
| Alkali metal carbonate | 0-60 | 0-45 | 0-35 | 0-25 |
| polymer comprising maleic acid, vinyl acetate and alkyl acrylate monomers | 0.1-20 | 1-15 | 1-10 | 1-5 |
| surfactant | 0-20 | 0-15 | 0-10 | 0-5 |
| Water | 0-80 | 0-70 | 0-60 | 0-50 |

Example Powder Detergent Compositions

| | Ex. Range 1 | Ex. Range 2 | Ex. Range 3 | Ex. Range 4 |
|---|---|---|---|---|
| alkali metal silicate | 10-90 | 10-90 | 30-70 | 30-70 |
| Alkali metal carbonate | 0-60 | 0-45 | 0-35 | 0-25 |
| polymer comprising maleic acid, vinyl acetate and alkyl acrylate monomers | 0.1-15 | 1-15 | 1-10 | 1-10 |

-continued

| | Ex. Range 1 | Ex. Range 2 | Ex. Range 3 | Ex. Range 4 |
|---|---|---|---|---|
| surfactant | 0-20 | 0-15 | 0-10 | 0-5 |
| Water | 0-30 | 0-20 | 0-15 | 0-10 |

Methods of Use

The detergent compositions can include concentrate compositions or can be diluted to form use compositions. In general, a concentrate refers to a composition that is intended to be diluted with water to provide a use composition that contacts an object to provide the desired cleaning, rinsing, or the like. The detergent composition that contacts the articles to be washed can be referred to as the use composition. The use composition can include additional functional ingredients at a level suitable for cleaning, rinsing, or the like.

A use composition may be prepared from the concentrate by diluting the concentrate with water at a dilution ratio that provides a use composition having desired detersive properties. The water that is used to dilute the concentrate to form the use composition can be referred to as water of dilution or a dilutent, and can vary from one location to another. The typical dilution factor is between approximately 1 and approximately 10,000 but will depend on factors including water hardness, the amount of soil to be removed and the like. In one embodiment, the concentrate is diluted at a ratio of between about 1:10 and about 1:1000 concentrate to water. Particularly, the concentrate is diluted at a ratio of between about 1:100 and about 1:5000 concentrate to water. More particularly, the concentrate is diluted at a ratio of between about 1:250 and 1:2000 concentrate to water.

A suitable concentration range of the components in the use composition includes between about 20 and 1,500 parts-per-million (ppm) alkali metal silicate source, and between about 20 and 1,000 ppm of the polymer containing maleic acid, vinyl acetate and alkyl acrylate monomers. A particularly suitable concentration range of components in the use composition includes between about 100 and 1,000 ppm alkali metal silicate source, and between about 20 and 500 ppm of the polymer containing the maleic acid, vinyl acetate and alkyl acrylate monomers. A more particularly suitable concentration range of components in the use composition includes between about 250 and 700 ppm alkali metal silicate source, and between about 20 and 500 ppm of the polymer containing the maleic acid, vinyl acetate and alkyl acrylate monomers.

Where the detergent composition includes secondary alkalinity sources, a suitable concentration range of the components in the use composition includes between about 1 and 2,000 ppm alkalinity source (which includes at least the alkali metal silicate source and at least one secondary alkalinity source), and between about 20 and 1,000 ppm of the polymer containing maleic acid, vinyl acetate and alkyl acrylate monomers. A particularly suitable concentration range of the components in the use composition includes between about 1 and 1,000 ppm alkalinity, and between about 1 and 250 ppm of the polymer containing maleic acid, vinyl acetate and alkyl acrylate monomers.

The use composition can be used at an elevated temperature. In one example, a use composition is used at a temperature between approximately 140° F. and approximately 185° F. to contact with the substrate to be cleaned. In another example, a use composition is used at a temperature between approximately 150° F. and approximately 160° F. to contact the substrate to be cleaned.

The use composition may contain one or more secondary alkaline sources. The use composition contains an effective concentration of the alkali metal silicate and the secondary alkaline sources (if present) so that the use composition has a pH of at least about 10.

The use composition can be brought into contact with soiled articles to clean the articles. In one example, the use composition is contacted with aluminum articles or articles containing aluminum. The maleic acid, vinyl acetate and alkyl acrylate polymer of the use composition may function as a metal protector and reduce corrosion of the aluminum.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight bases, and all reagents used in the examples were obtained, or are available, from the chemical suppliers described below, or may be synthesized by conventional techniques.

Materials Used

Pluronic® N-3: a ethylene oxide/propylene oxide block polymer surfactant available from BASF Corporation Belclene® 283: a maleic acid, ethyl acrylate and vinyl acetate terpolymer available from BWA Water Additives, Tucker, Ga.

Belclene® 810: a maleic acid, ethyl acrylate and vinyl acetate terpolymer available from BWA Water Additives, Tucker, Ga.

Samples 1 and 2 and Comparative Samples A and B

The raw materials identified for each of Samples 1 and 2 and Comparative Samples A and B in Table 4 below were combined and mixed to form concentrate detergent compositions. Sample 1 included 14.6 grams water from Belclene 283, and Sample 2 included 13.5 grams water from Belclene 810.

TABLE 4

| | Sample 1 | Sample 2 | Comp. Sample A | Comp. Sample B |
|---|---|---|---|---|
| Sodium metasilicate anhydrous (wt %) | 69.3 | 70.3 | 34.3 | 96.3 |
| Sodium carbonate (wt %) | 0 | 0 | 25.4 | 0 |
| Sodium tripolyphosphate (wt %) | 0 | 0 | 37.3 | 0 |
| Pluronic N3 (wt %) | 2.7 | 2.7 | 3 | 3.7 |
| Belclene 283 (47.9% active) (wt %) | 28 | 0 | 0 | 0 |
| Belclene 810 (50% active) (wt %) | 0 | 27 | 0 | 0 |
| Total wt % | 100 | 100 | 100 | 100 |

A warewash test was conducted with each composition using a Hobart AM-14 industrial warewash machine and a 13"×9" aluminum sheet pan.

Each aluminum pan was formed by cutting a 13"×18" aluminum pan in half. The aluminum pan was lightly cleaned with warm soapy water and a non-abrasive sponge to ensure any foreign material or reside from cutting and storage was removed.

Before the test was started, the warewash machine was filled with the desired water type, the heaters were turned on, and the final rinse temperature was set at 180 degrees Fahrenheit. The warewash machine was also primed with the concentrated detergent so that the concentration of metasilicate and/or sodium carbonate in the use composition was equal for each test. The aluminum pan was placed in a rack at the second slot from the front with the rim facing down and the cut edge facing up, and the rack was placed inside the warewash machine. At the beginning of each cycle, the appropriate amount of detergent was added to the wash tank to make up for the rinse dilution.

After 50 cycles, the aluminum pans were graded visually from 1 to 5 depending upon the amount of blackening/corrosion. The front and the back of each aluminum pan were given an individual grade. A rating of 1 indicates no corrosion or discoloration. A rating of 2 indicates approximately 25% of the pan is corroded and/or discolored. A rating of 3 indicates approximately 50% of the pan is corroded and/or discolored. A rating of 4 indicates approximately 75% of the pan is corroded and/or discolored. A rating of 5 indicates all or nearly all of the pan is heavily corroded and/or discolored.

The dosage, polymer concentration, and results of the warewash test are presented below in Table 5. "Front score" refers to the grade given to the front of the aluminum pan and "back score" refers to the grade given to the back of the aluminum pan.

TABLE 5

| | Dosage | Polymer | Polymer Conc. | Front Score | Back Score |
|---|---|---|---|---|---|
| Sample 1 | 0.75 g/l | 283 | 100 ppm | 1 | 1 |
| Sample 2 | 0.74 g/l | 810 | 100 ppm | 1 | 1 |
| Comp. Sample A | 1.4 g/l | N/A | N/A | 1 | 1 |
| Comp. Sample B | 0.54 g/l | N/A | N/A | 5 | 5 |

Samples 1 and 2, which were phosphorous-free and contained a maleic acid, ethyl acrylate and vinyl acetate terpolymer, both resulted in no corrosion or discoloration of the aluminum pan. The aluminum pan washed with Comparative Sample B, which phosphorous-free and contained no maleic acid, ethyl acrylate and vinyl acetate terpolymer, was entirely or nearly entirely heavily discolored and/or corroded on the front and back.

Samples 3 and 4 and Comparative Sample C

Samples 3 and 4 and Comparative Sample C set forth in Table 6 were prepared in the same manner as Samples 1 and 2 and Comparative Samples A and B. Samples 3 and 4 and Comparative Sample C included sodium carbonate. Sample 3 included

TABLE 6

| | Sample 3 | Sample 4 | Comp. Sample C |
|---|---|---|---|
| Sodium metasilicate anhydrous (wt %) | 49.5 | 50 | 70.3 |
| Sodium carbonate (wt %) | 28.5 | 28.9 | 27 |
| Sodium tripolyphosphate (wt %) | 0 | 0 | 0 |
| Pluronic N3 (wt %) | 2 | 1.9 | 2.7 |
| Belclene 283 (47.9% active) (wt %) | 20 | 0 | 0 |
| Belclene 810 (50% active) (wt %) | 0 | 19.2 | 0 |
| Total wt % | 100 | 100 | 100 |

A warewash test was conducted with the compositions of Samples 3 and 4 and Comparative Sample C according the procedure described above with respect to Samples 1 and 2 and Comparative Samples A and B. The dosage, polymer concentration, and results of the warewash test are presented below in Table 7.

TABLE 7

| | Dosage | Polymer | Polymer Conc. | Front Score | Back Score |
|---|---|---|---|---|---|
| Sample 3 | 1.05 g/l | 283 | 100 ppm | 1.5 | 1.5 |
| Sample 4 | 1.04 g/l | 810 | 100 ppm | 1 | 2 |
| Comp. Sample C | 0.74 g/l | N/A | N/A | 5 | 5 |

The aluminum pan washed with the composition of Comparative Sample C, which was phosphorous-free and contained no maleic acid, alkyl acrylate and vinyl acetate terpolymer, was entirely or nearly entirely heavily discolored and/or corroded on the front and back. The aluminum pans washed with the compositions of Samples 3 and 4, which were phosphorous-free and contained sodium carbonate and a maleic acid, ethyl acrylate and vinyl acetate terpolymer, overall experienced less discoloration and/or corrosion than that washed with Comparative Sample C.

Samples 5-7 and Comparative Samples D and E

Samples 5-7 and Comparative Samples D and E set forth in Table 8 were prepared in the same manner as Samples 1 and 2 and Comparative Samples A and B.

TABLE 8

| | Sample 5 | Sample 6 | Sample 7 | Comp. Sample D | Comp. Sample E |
|---|---|---|---|---|---|
| Sodium metasilicate anhydrous (wt %) | 69.3 | 70.3 | 81.3 | 34.3 | 96.3 |
| Sodium carbonate (wt %) | 0 | 0 | 0 | 25.4 | 0 |
| Sodium tripoly-phosphate (wt %) | 0 | 0 | 0 | 37.3 | 0 |
| Pluronic N3 (wt %) | 2.7 | 2.7 | 3.1 | 3 | 3.7 |
| Belclene 283 (47.9% active) (wt %) | 28 | 0 | 0 | 0 | 0 |
| Belclene 810 (50% active) (wt %) | 0 | 27 | 15.6 | 0 | 0 |
| Total wt % | 100 | 100 | 100 | 100 | 100 |

A warewash test was conducted with the compositions of Samples 5-7 and Comparative Samples D and E according the procedure described above with respect to Samples 1 and 2 and Comparative Samples A and B except that a Hobart AM-15 industrial warewash machine was used. The dosage, polymer concentration, and results of the warewash test are presented below in Table 9.

TABLE 9

| | Dosage | Polymer | Polymer Conc. | Front Score | Back Score |
|---|---|---|---|---|---|
| Sample 5 | 0.75 g/l | 283 | 100 ppm | 1 | 1 |
| Sample 6 | 0.74 g/l | 810 | 100 ppm | 1 | 1 |
| Sample 7 | 0.64 g/l | 810 | 50 ppm | 2 | 1.5 |
| Comp. Sample D | 1.4 g/l | N/A | N/A | 1 | 1 |
| Comp. Sample E | 0.54 g/l | N/A | N/A | 5 | 5 |

Comparative Sample E, which was phosphorous-free and contained no maleic acid, alkyl acrylate and vinyl acetate polymer, resulted in an aluminum pan that was entirely or nearly entirely heavily discolored and/or corroded on the front and back. Aluminum pans washed with the compositions of Samples 5-7, which were phosphorous-free and contained no phosphate and a maleic acid, ethyl acrylate and vinyl acetate terpolymer, had little to no corrosion or discoloration.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A method of cleaning an aluminum article, the method comprising:

contacting the aluminum article with a use composition including an alkalinity source and a polymer consisting of maleic acid, vinyl acetate and alkyl acrylate monomers;

wherein the alkalinity source consists of at least one alkali metal silicate and optionally at least one alkali metal carbonate; and wherein the alkali metal silicate is present in a greater amount by weight than the alkali metal carbonate;

wherein the use composition has a polymer concentration of approximately 20 to approximately 1,000 parts per million (ppm) and a pH of at least 10; and wherein the use composition is free of carboxymethylcellulose.

2. The method of claim 1, wherein the alkali metal carbonate comprises sodium carbonate.

3. The method of claim 1, wherein the use solution further comprises an ethylene oxide/propylene oxide polymer.

4. The method of claim 1, wherein the polymer is a maleic acid, vinyl acetate and alkyl acrylate terpolymer.

5. The method of claim 1, wherein the polymer consists of:

a. a monomer of maleic acid in an amount of between approximately 30% and approximately 99% by weight of the polymer;

b. a vinyl acetate monomer in an amount of between approximately 1% and approximately 60% by weight of the polymer; and c. an alkyl acrylate monomer in an amount of between approximately 1% and approximately 60% by weight of the polymer.

6. The method of claim 1, wherein the alkyl acrylate and vinyl acetate monomers include at least one hydrolyzed vinyl acetate or alkyl acrylate monomer.

7. The method of claim 1, wherein the alkyl acrylate is selected from the group consisting of methyl acrylate, ethyl acrylate, propyl acrylate, butyl acrylate, isopropyl acrylate and tert-butyl acrylate.

* * * * *